US009328934B2

(12) United States Patent
Mercer et al.

(10) Patent No.: US 9,328,934 B2
(45) Date of Patent: May 3, 2016

(54) HVAC SYSTEM SUBCOOLER

(71) Applicant: Trane International Inc., Piscataway, NJ (US)

(72) Inventors: Kevin Bruce Mercer, Danville, IN (US); John Raymond Edens, Kilgore, TX (US)

(73) Assignee: Trane International Inc., Piscataway, NJ (US)

( * ) Notice: Subject to any disclaimer, the term of this patent is extended or adjusted under 35 U.S.C. 154(b) by 173 days.

(21) Appl. No.: 13/959,402

(22) Filed: Aug. 5, 2013

(65) Prior Publication Data

US 2015/0033776 A1 Feb. 5, 2015

(51) Int. Cl.

| | |
|---|---|
| ***F25B 39/00*** | (2006.01) |
| ***F25B 39/02*** | (2006.01) |
| ***F25B 40/02*** | (2006.01) |
| ***F24F 1/26*** | (2011.01) |
| ***F24F 1/00*** | (2011.01) |
| ***F28D 1/047*** | (2006.01) |
| *F28D 1/04* | (2006.01) |

(52) U.S. Cl.

CPC ..... *F24F 1/26* (2013.01); *F24F 1/0007* (2013.01); *F24F 1/0059* (2013.01); *F28D 1/047* (2013.01); *F24F 2001/004* (2013.01); *F24F 2221/34* (2013.01); *F28D 1/0435* (2013.01); *F28D 1/0477* (2013.01)

(58) Field of Classification Search

CPC ..... F25B 39/00; F25B 39/02; F25B 39/022; F25B 29/003; F25B 17/06; F25B 40/00; F25B 40/02; F24F 1/0007; F24F 1/0059; F24F 3/0525; F24F 2001/004

See application file for complete search history.

(56) References Cited

U.S. PATENT DOCUMENTS

| | | | | |
|---|---|---|---|---|
| 3,722,583 | A * | 3/1973 | Fiedler | B01D 53/26 165/156 |
| 4,287,724 | A | 9/1981 | Clark | |
| 4,483,156 | A * | 11/1984 | Oudenhoven | F25B 39/00 62/324.1 |
| 5,086,626 | A | 2/1992 | Iida | |
| 5,329,782 | A | 7/1994 | Hyde | |
| 5,329,783 | A | 7/1994 | Yang | |
| 6,116,048 | A * | 9/2000 | Hebert | F24F 1/0059 62/524 |
| 6,123,147 | A | 9/2000 | Pittman | |
| 6,385,985 | B1 * | 5/2002 | Bussjager et al. | 62/259.1 |
| 7,165,414 | B2 * | 1/2007 | Wright | 62/277 |
| 7,721,560 | B2 * | 5/2010 | Carpenter | 62/176.6 |
| 2002/0023443 | A1 * | 2/2002 | Eber et al. | 62/172 |
| 2004/0003915 | A1 * | 1/2004 | Shippy et al. | 165/151 |
| 2005/0047974 | A1 * | 3/2005 | Martin | A61L 9/16 422/121 |
| 2006/0037354 | A1 * | 2/2006 | Cho | F24F 1/0059 62/419 |
| 2006/0288713 | A1 * | 12/2006 | Knight | F24F 3/153 62/176.6 |
| 2010/0326624 | A1 * | 12/2010 | Hancock | F24F 3/0442 165/47 |
| 2011/0126560 | A1 * | 6/2011 | Wightman | 62/80 |
| 2011/0138849 | A1 * | 6/2011 | Hirano et al. | 62/513 |
| 2011/0237177 | A1 * | 9/2011 | Stewart et al. | 454/338 |

* cited by examiner

*Primary Examiner* — Frantz Jules
*Assistant Examiner* — Erik Mendoza-Wilkenfe
(74) *Attorney, Agent, or Firm* — Conley Rose, P.C.; J. Robert Brown, Jr.; Michael J. Schofield

(57) ABSTRACT

An air handling unit has a refrigeration coil assembly and a subcooler circuit disposed in a downstream airflow path relative to the refrigeration coil assembly.

12 Claims, 5 Drawing Sheets

HVAC SYSTEM SUBCOOLER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems sometimes provide less than desired subcooling.

SUMMARY

In some embodiments of the disclosure, an air handling unit is disclosed as comprising a refrigeration coil assembly and a subcooler circuit disposed in a downstream airflow path relative to the refrigeration coil assembly.

In other embodiments of the disclosure, a method of operating an HVAC system is disclosed as comprising locating a subcooler circuit within an airflow downstream relative to a refrigeration coil assembly, transferring refrigerant from an output of a condenser coil to an input of the subcooler circuit, and reducing a temperature of the refrigerant within the subcooler circuit using air exiting the refrigeration coil assembly.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some HVAC systems comprise subcooler assemblies that provide less than desired subcooling. In some embodiments of this disclosure, a subcooler assembly is provided that comprises a spine fin heat exchanger tube disposed within an output stream of a refrigeration evaporator coil.

Figure 1:
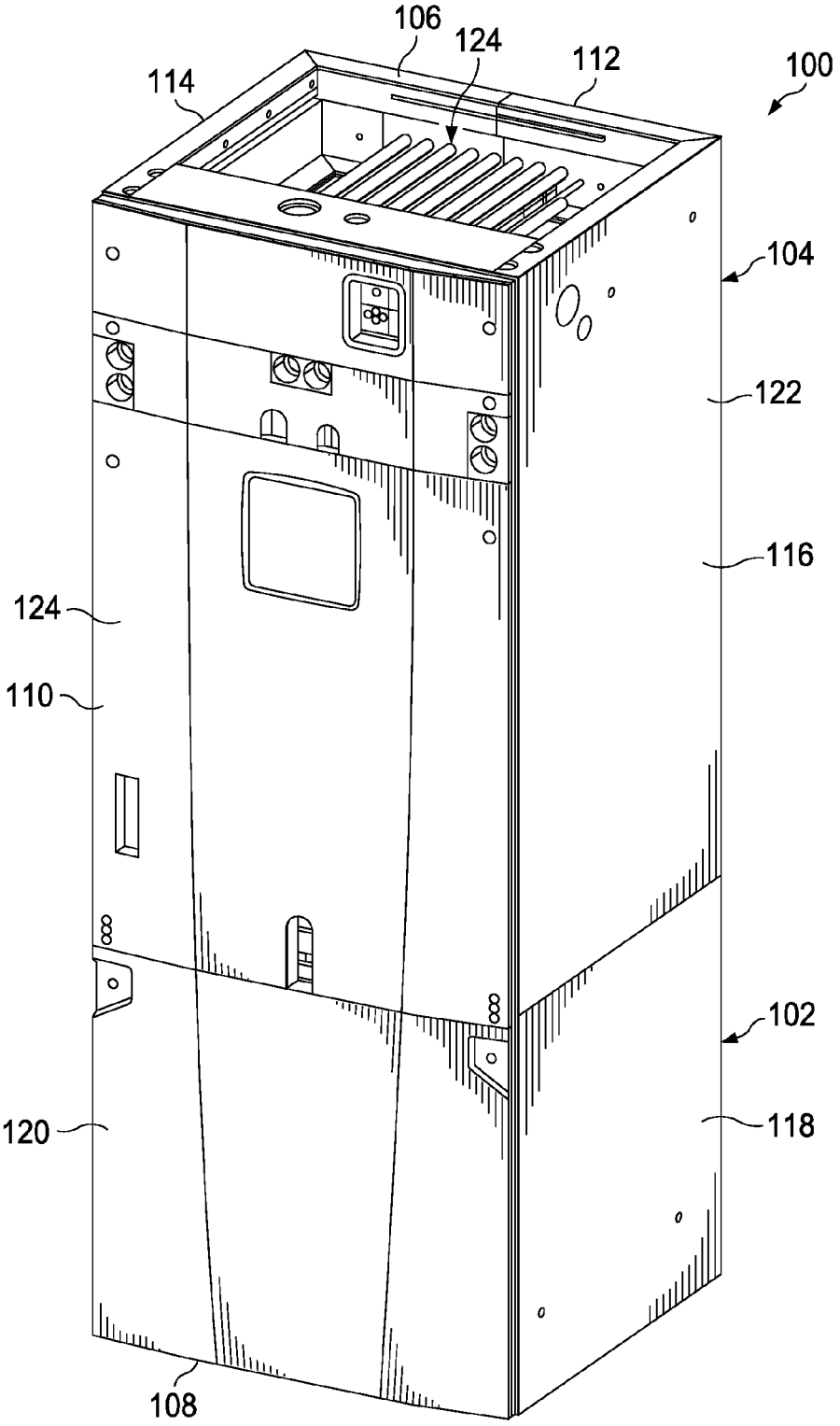
FIG. 1 is an oblique view of an air handling unit according to embodiments of the disclosure.
Figure 2:
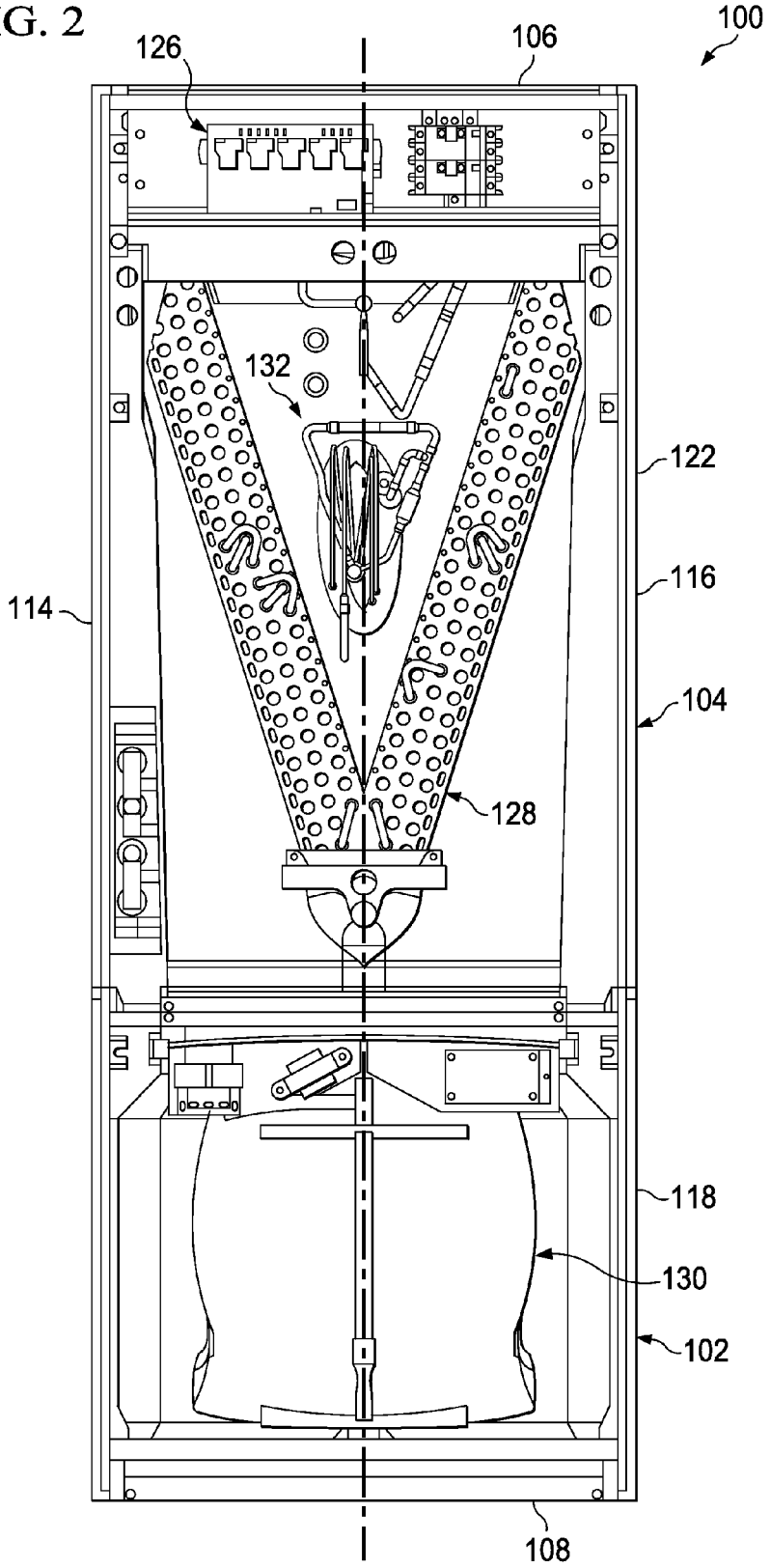
FIG. 2 is an orthogonal view of the front of the air handling unit of FIG. 1.
Figure 3:
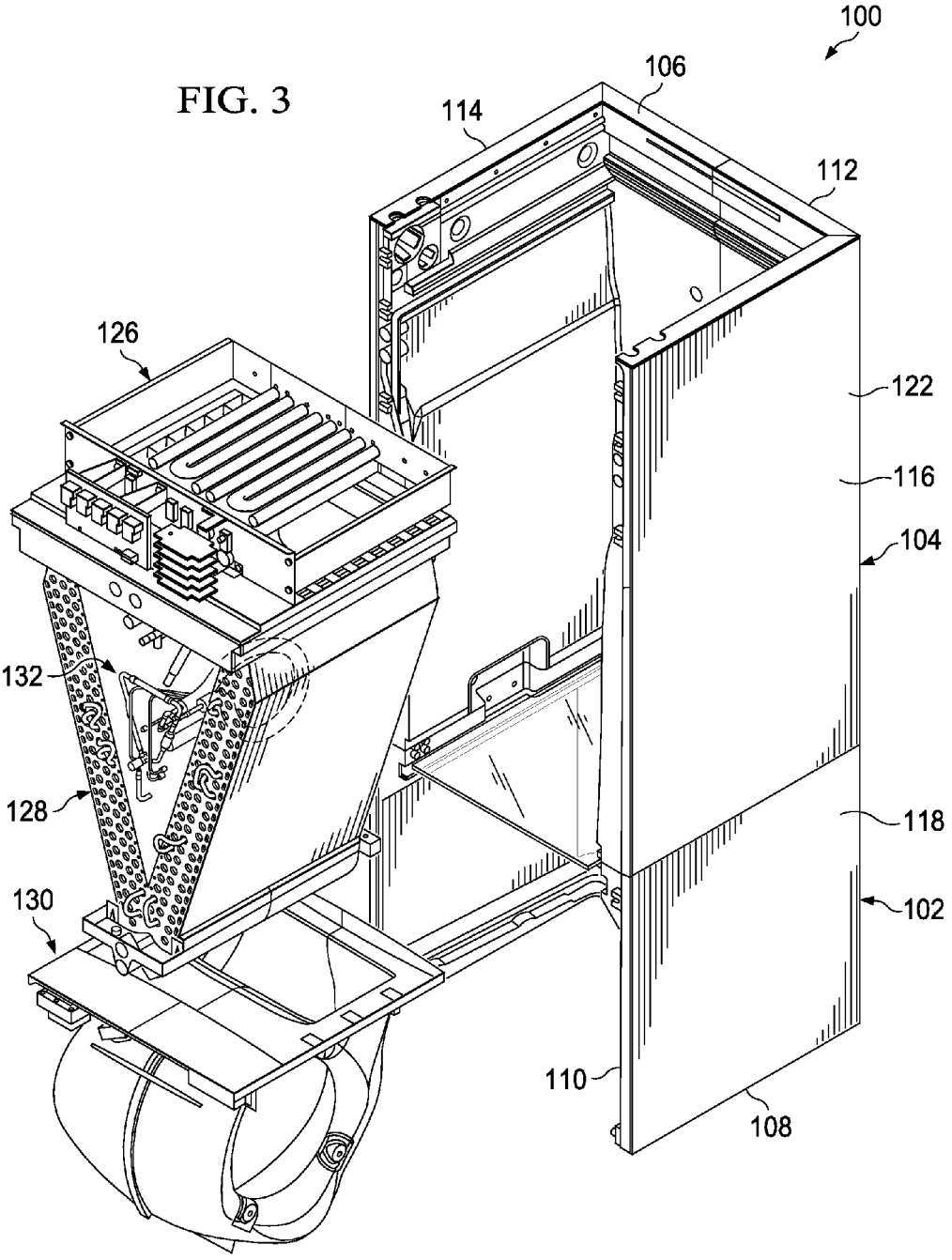
FIG. 3 is a partially exploded oblique view of the air handling unit of FIG. 1.

Referring now to FIGS. 1-3, an air handling unit (AHU) 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. Such directional descriptions are meant to assist the reader in understanding the physical orientation of the various components parts of the AHU 100 but such directional descriptions shall not be interpreted as limitations to the possible installation orientations of an AHU 100. Further, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100, but rather, that a plurality of shown and/or labeled directional descriptions in a single Figure shall provide general directional orientation to the reader so that directionality may be easily followed amongst various figures. Still further, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. The blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. The heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. The AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

The AHU 100 further comprises a subcooler assembly 132 at least partially disposed downstream relative to the refrigeration coil assembly 128.

Figure 4:
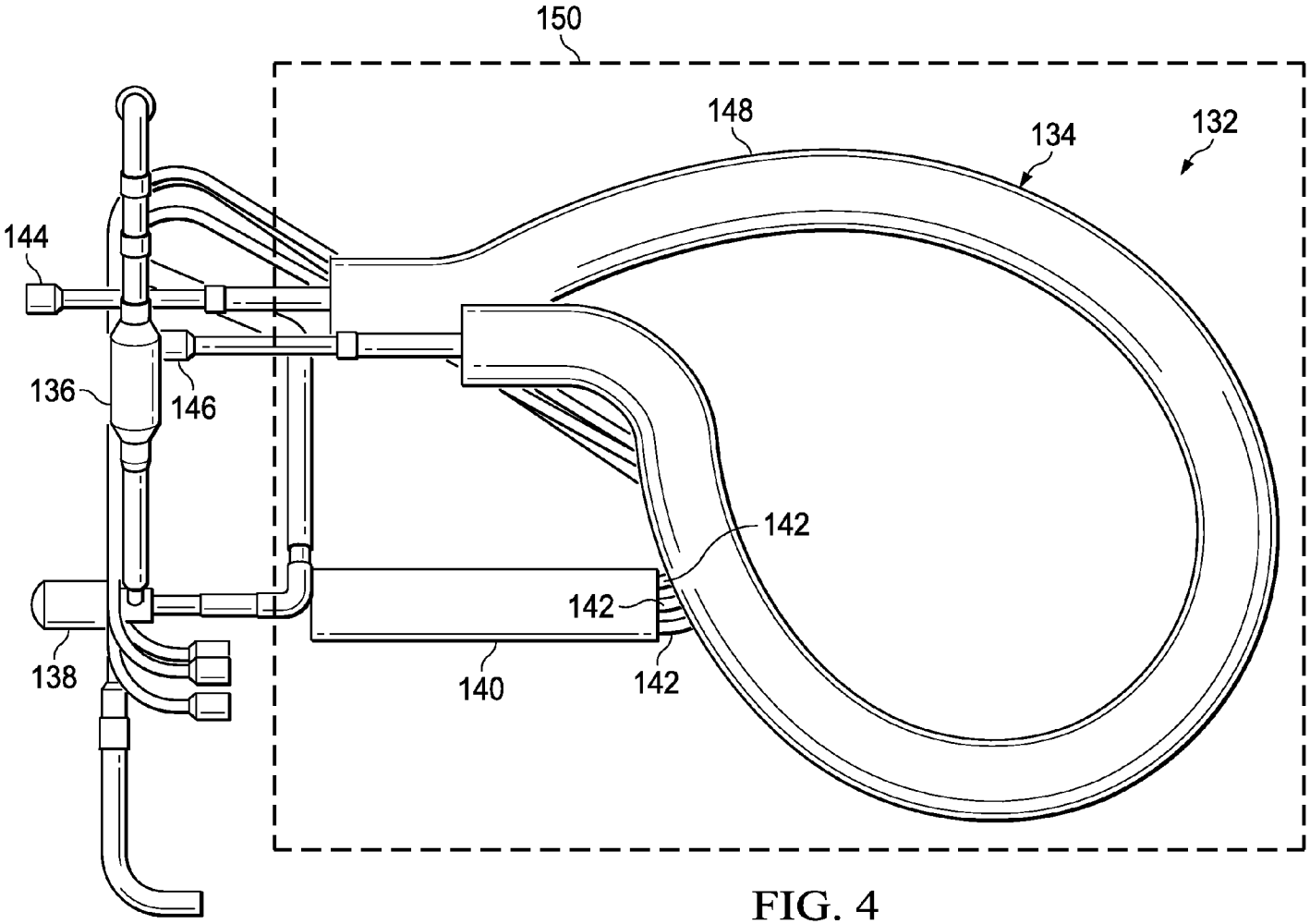
FIG. 4 is an orthogonal right view of the subcooler assembly of FIG. 2.
Figure 5:
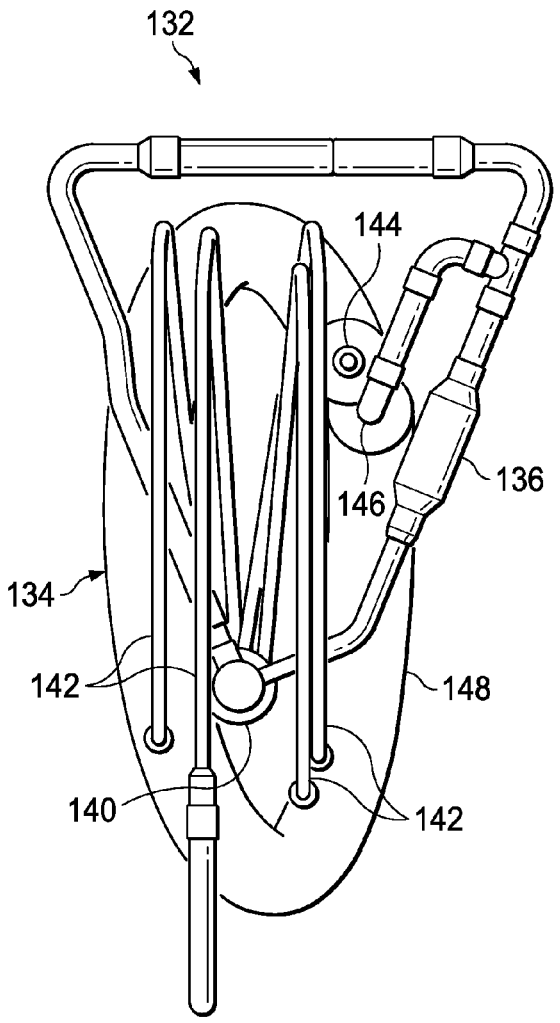
FIG. 5 is an orthogonal front view of the subcooler assembly of FIG. 2.

Referring now to FIGS. 4 and 5, the subcooler assembly 132 is shown in greater detail. The subcooler assembly 132 comprises a subcooler circuit 134, a check valve 136, an electronic expansion valve 138, a distributor 140, and distributor tubes 142. The subcooler circuit 134 comprises a subcooler circuit inlet 144, a subcooler circuit outlet 146, and a spine fin coil heat exchanger portion 148. In this embodiment, a refrigerant liquid line output from a condenser heat exchanger may feed directly into the subcooler circuit inlet 144 to feed the subcooler circuit 134 with refrigerant. In some embodiments, at least the portion encompassed within dotted line 150 is located directly downstream of airflow that passes through the refrigeration coil assembly 128. Because the air passing through the refrigeration coil assembly 128 is necessarily cooled by the refrigeration coil assembly 128 to a temperature less than that of the temperature of the refrigerant supplied to the subcooler circuit inlet 144, some amount of subcooling of the refrigerant is guaranteed prior to passing the refrigerant from the subcooler circuit 134 to the electronic expansion valve 138. In this embodiment, the spine fin coil heat exchanger portion 148 is of a substantially different construction than that of the plate fin slab type construction of the refrigeration coil assembly 128. The subcooled refrigerant is passed from the subcooler circuit 134 to the electronic expansion valve 138 which causes a reduction in pressure of the refrigerant prior to feeding the refrigerant into the distributor 140. The lower pressure refrigerant is passed from the distributor 140 into distributor tubes 142 that feed circuits of the refrigeration coil assembly 128. In some embodiments, the AHU 100 may comprise any other suitable type of refrigerant expansion device such as a thermal expansion valve rather than the electronic expansion valve 138. In some embodiments, the AHU 100 may comprise no check valve 136 while in some embodiments the check valve 136 may be disposed in parallel with a refrigerant expansion device.

Figure 6:
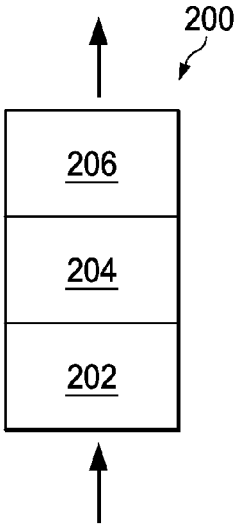
FIG. 6 is a schematic view of an air handling unit (AHU) according to an alternative embodiment.

Referring now to FIG. 6, an alternative embodiment of an AHU 200 is schematically shown. The AHU 200 is generally a pull-through type AHU that comprises a refrigeration coil assembly 202, a subcooler circuit 204 substantially similar to subcooler circuit 134, and a blower assembly 206. In operation, the blower assembly 206 pulls air through the refrigeration coil assembly 202 thereby cooling the air to a temperature less than the temperature of the refrigerant supplied to the subcooler circuit 204. The cooled air passes out of the refrigeration coil assembly 202 and travels downstream into contact with the subcooler circuit 204.

It will be appreciated that the subcooler circuits disclosed herein may comprise different tubular paths and/or path shapes. Regardless the tubular path and/or shape of the subcooler circuits, in some embodiments the subcooler circuits nonetheless comprise spine fin heat exchanger tube construction and at least a portion of the subcooler circuit that comprises the spine fin heat exchanger tube construction is disposed in an airflow path downstream relative to the refrigeration coil assembly. In alternative embodiments, any combination of V-coils, A-coils, blow through type AHU, pull through type AHU may be utilized in combination with the subcooler circuits disclosed herein. Still further, while substantially all of the spine fin coil heat exchanger portion of the subcooler circuits are disclosed as being located within the airflow downstream relative to the refrigeration coil assembly, in alternative embodiments, only some of a spine fin coil heat exchanger portion of the subcooler circuits may be disposed within the airflow downstream relative to the refrigeration coil. Further, while substantially all of the spine fin coil heat exchanger portion of the subcooler circuits are disclosed as being located between plate fin slabs of the refrigeration coil assembly, in alternative embodiments, only some or none of a spine fin coil heat exchanger portion of the subcooler circuits may be disposed between plate fin slabs of the refrigeration coil.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

a refrigeration coil assembly comprising at least two plate fin slabs arranged in a V-coil arrangement; and a subcooler assembly, comprising:

a subcooler circuit disposed between the at least two plate fin slabs of the refrigeration coil assembly and in a downstream airflow path relative to the refrigeration coil assembly, wherein no portion of the subcooler circuit is disposed further downstream than a most downstream end of either of the at least two slabs of the refrigeration coil assembly;

a refrigerant expansion device configured to reduce a pressure of refrigerant received via an output of the subcooler circuit; and a distributor configured to receive refrigerant from an output of the refrigerant expansion device and feed the refrigerant through a plurality of distributor tubes to a plurality of circuits disposed in each of the at least two plate fin slabs of the refrigeration coil assembly;

wherein the entirety of the subcooler assembly is disposed between the at least two plate fin slabs of the refrigeration coil assembly and in a downstream airflow path relative to the refrigeration coil assembly.

2. The air handling unit of claim 1, wherein at least a portion of the subcooler circuit comprises a spine fin heat exchanger type construction.

3. The air handling unit of claim 2, wherein the refrigeration coil assembly comprise a construction type other than the spine fin heat exchanger type construction.

4. The air handling unit of claim 1, further comprising:

a blower assembly located in a downstream airflow path relative to the refrigeration coil assembly.

5. The air handling unit of claim 1, further comprising:

a blower assembly located in an upstream airflow path relative to the refrigeration coil assembly.

6. The air handling unit of claim 1, wherein the subcooler circuit is directly connected to a refrigerant liquid line output of a condenser heat exchanger.

7. The air handling unit of claim 1, further comprising:

an optional check valve connected to the output of the subcooler circuit.

8. The air handling unit of claim 7, wherein when the optional check valve is present, the refrigerant expansion device is connected in parallel to the optional check valve.

9. A method of operating an HVAC system, comprising:

providing a refrigeration coil assembly comprising at least two plate fin slabs arranged in a V-coil arrangement;

locating a subcooler assembly comprising a subcooler circuit, a refrigerant expansion device, a distributor, and a plurality of distributor tubes between the at least two plate fin slabs of the refrigeration coil and within an airflow downstream relative to a refrigeration coil assembly, wherein no portion of the subcooler assembly is disposed further downstream than a most downstream end of either of the at least two slabs of the refrigeration coil assembly;

transferring refrigerant from an output of a condenser coil to an input of the subcooler circuit;

reducing a temperature of the refrigerant within the subcooler circuit using air exiting the refrigeration coil assembly;

transferring the refrigerant within the subcooler circuit from an output of the subcooler circuit to the refrigerant expansion device;

reducing a pressure of the refrigerant via the refrigerant expansion device;

transferring the refrigerant from an output of the refrigerant expansion device to the distributor; and distributing the temperature and pressure reduced refrigerant from the distributor through the plurality of distributor tubes to a plurality of circuits disposed in each of the at least two plate fin slabs of the refrigeration coil assembly.

10. The method of claim 9, wherein the refrigerant expansion device comprises an electronic expansion valve.

11. The method of claim 9, further comprising using a blower assembly to push the air through the refrigeration coil assembly.

12. The method of claim 9, further comprising using a blower assembly to pull the air through the refrigeration coil assembly.

* * * * *